US005181775A

United States Patent [19]

Lan

[11] Patent Number: 5,181,775

[45] Date of Patent: Jan. 26, 1993

[54] NON-POLLUTING FIRECRACKER DEVICE

[76] Inventor: Ching-Hwei Lan, No. 9, Alley 1, Lane 458, Yuang Ho Rd., Chung Ho City, Taiwan

[21] Appl. No.: 729,106

[22] Filed: Jul. 12, 1991

[51] Int. Cl.[5] ..... F21V 33/00

[52] U.S. Cl. ..... 362/234; 362/86; 362/184; 362/806; 446/398

[58] Field of Search ..... 362/86, 184, 234, 252, 362/253, 806; 446/175, 398; 431/359, 365; 40/442

[56] References Cited

U.S. PATENT DOCUMENTS 4,264,845 4/1981 Bednarz ..... 362/806 X
4,992,912 2/1991 Lee ..... 362/86
4,999,753 3/1991 Mackenzie ..... 362/234

*Primary Examiner*—Stephen F. Husar
*Attorney, Agent, or Firm*—Browdy and Neimark

[57] ABSTRACT

A non-polluting firecracker device having a plurality of firecracker units in a manner that each two form one set respectively strung on a major power lead, whose upper end extends into a control box where it connects with the sound-and-light circuit of a PC board thereof. Each firecracker unit consists of a firecracker-shaped casing through which light can penetrate and a small flash bulb in it. As the circuit is energized, there will be continued firecracker bursting sounds and, in the meantime, flashes sent out from bottom to top in an orderly, repeated way. This way, the same effects of letting off firecrackers are obtained but without generating trash and noxious gases. In addition, it may be used repeatedly to save money.

2 Claims, 2 Drawing Sheets

NON-POLLUTING FIRECRACKER DEVICE

FIELD OF THE INVENTION

This invention relates to a non-polluting firecracker device. Specifically, it relates to a new device that would send out the same firecracker bursting sounds and lights but without causing trash and noxious gases that would otherwise seriously pollute the environment.

BACKGROUND OF THE INVENTION

People in the countries of Southern Asia are used to letting off firecrackers in order to increase happiness and drive away evil in their celebrations of festivals. But in letting off firecrackers, there would be a great deal of trash generated. Moreover, the noxious gases sent into the air could sometimes be so heavy in density as to force people nearby to attempt to suspend breathing for awhile. And, as we are well aware, many of the accidents and injury cases are firecracker-related.

OBJECTS OF THE INVENTION

In order to overcome the shortcomings of a conventional firecracker, the present invention provides a non-polluting firecracker device of which the features are:

1. In use, the device will send out the same firecracker bursting sounds and lights but not burst itself and generate trash.
2. No great amount of irritant gases would be caused by the device in use and, hence, the surrounding air would keep clean.
3. The user of the device is absolutely safe without possibility of causing an accidental fire.
4. Since it may be used repeatedly, much money could be saved.

SUMMARY OF THE INVENTION

The non-polluting firecracker device consists of a plurality of firecracker unit in a manner of each two as one set respectively strung on a major power lead. Each firecracker unit includes a small flash bulb installed in a firecracker-shaped casing through which light passes. Of the major power lead, the upper end extends into a control box where it connects with the sound-and-light circuit of a PC board thereof. Therefore, as the circuit is energized, there will be continued firecracker bursting sounds and flashes which are transmitted simultaneously in an orderly way from bottom to top. In this way, the same effects of letting off firecrackers are obtained but without generating trash and noxious gases that would otherwise seriously pollute the environment.

DETAILED DESCRIPTION OF A PREFERRED EMBODIMENT

Figure 1:
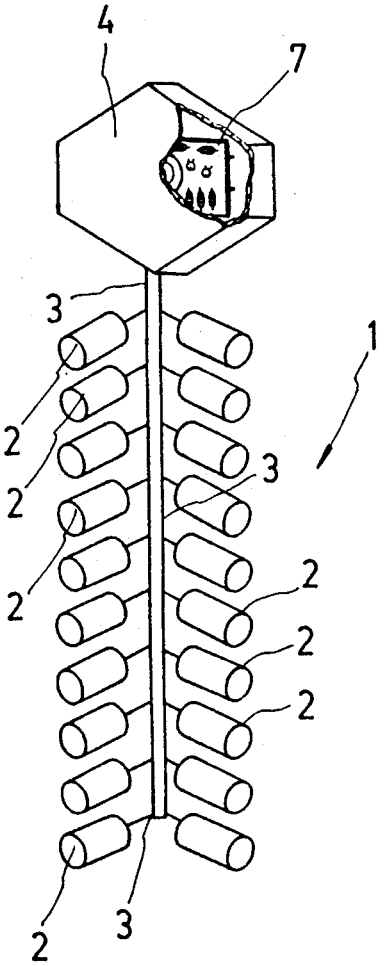
FIG. 1 is a perspective view of a preferred embodiment according to the invention.
Figure 3:
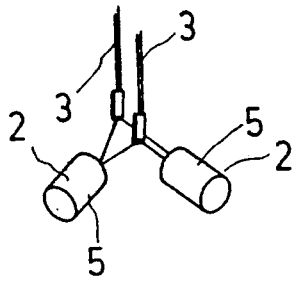
FIG. 3 shows a connection of a set of two firecracker unit of the invention.
Figure 2:
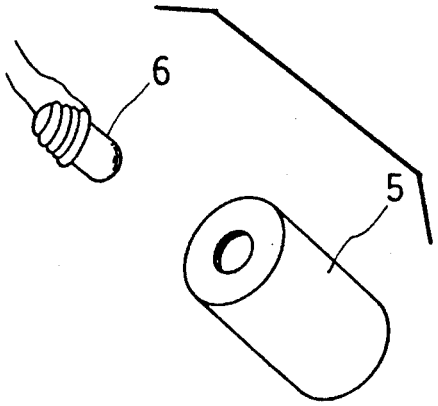
FIG. 2 is a exploded view of the firecracker unit in FIG. 1.

As FIGS. 1-3 show, a non-polluting firecracker device 1 consists of a plurality of firecracker units 2 in a manner so that each two are as one set respectively strung on major power lead 3 with a control box 4 at the top. In its exterior view, non-polluting firecracker device 1 looks the same as conventional firecrackers strung in a series on a line. Each firecracker unit 2 includes a small flash bulb 6 in a plastic, firecracker shaped casing 5 through which light can pass. Small flash bulb 6 has both of its positive and negative poles connected with a power lead respectively. By means of those power leads, every set of each two firecracker units 2 can respectively connect with the positive and negative power leads of major power lead 3 and in this way be strung together in series (as FIG. 3 shows). Of major power lead 3, the upper end extends into an opaque control box 4 where it connects with the sound-and-light circuit of PC board 7 thereof.

Figure 4:
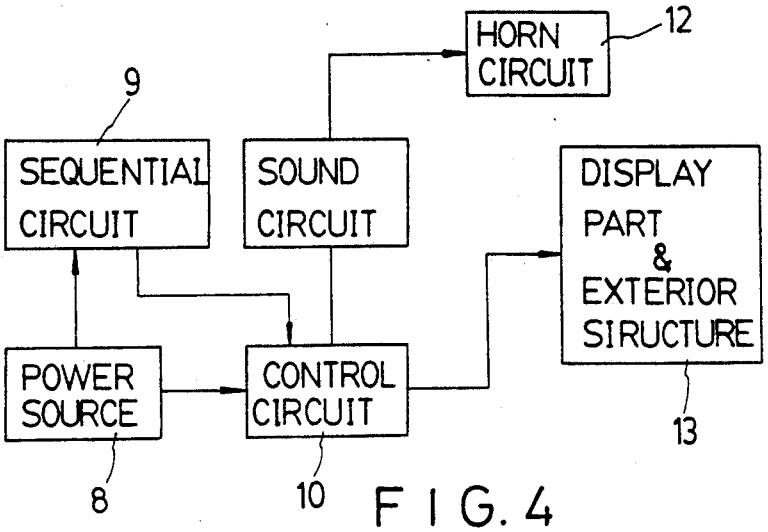
FIG. 4 is a block diagram of the sound-and-light circuit of the invention.
Figure 5:
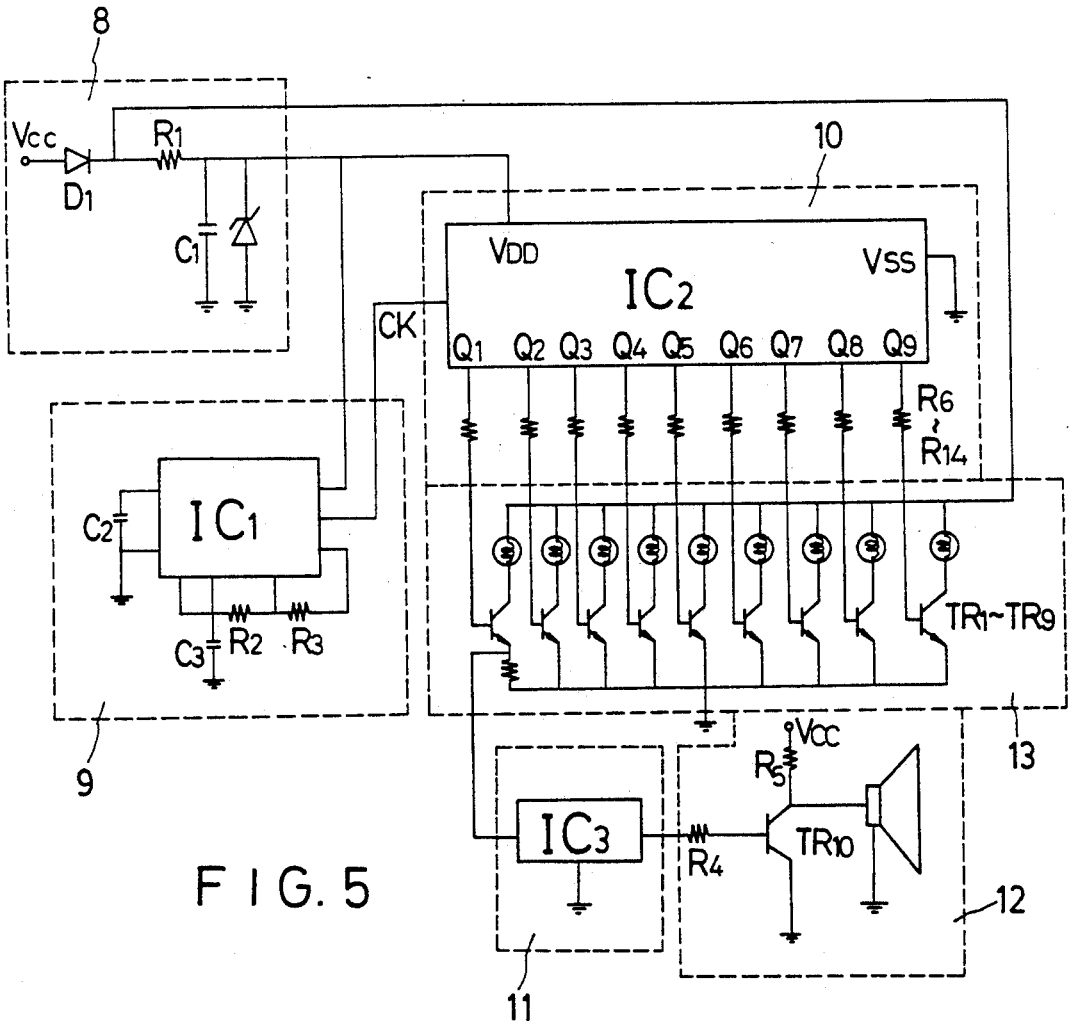
FIG. 5 is a circuit diagram of the sound-and-light circuit of FIG. 4.

As FIGS. 4, 5 show, the sound-and-light circuit of PC board 7 in control box 4 is provided from power source 8 after voltage regulation by sequential circuit 9 and control circuit 10. Sequential circuit 9 provides a time sequence by means of oscillation circuit IC 1 and resistors and capacitors. The length of the sequence is decided by the number of firecracker units 2 provided in the exterior structure 13 and realized by dividing play time of the music IC 3 of recorded sound circuit 11 into parts. Thereby, as power source 8 is energized in use, sequential circuit 9 will activate control circuit 10 and cause firecracker bursting sounds to be sent out from music IC 3 of recorded sound circuit 11 through the horn circuit 12 and, in the meantime, generate flashes from small flash bulb 6 of firecracker unit 2 in the exterior structure 13 in an orderly, repeated way from bottom to top.

I claim:

1. A non-polluting firecracker device comprising a control box;

a sound and light control circuit in said control box;

sound producing means to produce firecracker bursting sounds connected to said sound and light control circuit;

a power lead with positive and negative poles extending into said control box and connected to said sound and light control circuit;

a plurality of firecracker units in sets of two with each said set of two strung in series with said other sets along said power lead;

each said firecracker unit including a casing in the shape of a firecracker formed of a plastic through which light penetrates, a flash bulb within said casing having one lead connected to said positive pole and another lead connected to said negative pole of said power lead;

said sound and light control circuit including sequential means to fire said sets in sequence along said power lead in a direction toward said control box upon energization of said control circuit in accompaniment with firecracker bursting sounds from said sound producing means.

2. The non polluting firecracker device of claim 1 wherein said sound and light control circuit further includes a power source, a sequential circuit in said sequential means connected to said power source;

said sound producing means includes a recorded sound circuit having a predetermined play time, a horn circuit connected to play sound from said recorded sound circuit;

said sequential circuit includes an oscillation circuit and connecting resistor and capacitor means to provide a time sequence whose length is determined by the number of said firecracker units and dividing said play time of said recorded sound circuit into parts for the said number of said firecracker units.

* * * * *